US009766576B2

(12) United States Patent
Koyama

(10) Patent No.: US 9,766,576 B2
(45) Date of Patent: Sep. 19, 2017

(54) IMAGE FORMING APPARATUS, CONTROL METHOD OF IMAGE FORMING APPARATUS, AND COMPUTER-READABLE MEDIUM STORING COMPUTER-READABLE INSTRUCTIONS

(71) Applicant: Brother Kogyo Kabushiki Kaisha, Nagoya-shi, Aichi-ken (JP)

(72) Inventor: Tatsuya Koyama, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,542

(22) Filed: Jul. 29, 2016

(65) Prior Publication Data

US 2017/0031279 A1 Feb. 2, 2017

(30) Foreign Application Priority Data

Jul. 31, 2015 (JP) ..... 2015-152317

(51) Int. Cl.
*G03G 15/20* (2006.01)

(52) U.S. Cl.
CPC . *G03G 15/2046* (2013.01); *G03G 2215/2035* (2013.01)

(58) Field of Classification Search
CPC ..... G03G 15/2046; G03G 2215/2035
USPC ..... 399/69
See application file for complete search history.

(56) References Cited

U.S. PATENT DOCUMENTS

2004/0190924 A1 9/2004 Iwasaki et al.
2014/0086600 A1* 3/2014 Cui ..... G03G 15/55 399/33

FOREIGN PATENT DOCUMENTS

JP 2004-302152 A 10/2004
JP 2007-298553 A 11/2007
JP 5498977 B2 * 5/2014 ..... G03G 15/205

* cited by examiner

*Primary Examiner* — Susan Lee
(74) *Attorney, Agent, or Firm* — Banner & Witcoff, Ltd.

(57) ABSTRACT

An image forming apparatus includes an image forming unit, a heater, a heat receiving member configured to fix a toner image on a sheet, a first temperature sensor configured to sense a first temperature of the heat receiving member, a second temperature sensor configured to sense a second temperature of the heat receiving member, and a controller. The controller is configured to, after the image forming unit starts image formation: when a difference between the first temperature and the second temperature exceeds a threshold value a first number of times, perform a temperature reduction control in which the controller reduces a number of sheets to be printed per unit time and the image forming unit performs image formation for the reduced number of sheets to be printed per unit time; and increase the threshold value in accordance with a time elapsed.

16 Claims, 9 Drawing Sheets

Fig.5

| | | TIME ELAPSED FROM START OF SHEET SUPPLY | | | | |
|---|---|---|---|---|---|---|
| | | 0~4s | 4s~8s | 8s~16s | 16s~24s | 24s~ |
| T1 | ~100°C | 10 | 20 | 30 | 35 | 40 |
| | 100°C~140°C | 10 | 20 | 30 | 35 | 40 |
| | 140°C~ | 20 | 30 | 40 | 45 | 50 |

IMAGE FORMING APPARATUS, CONTROL METHOD OF IMAGE FORMING APPARATUS, AND COMPUTER-READABLE MEDIUM STORING COMPUTER-READABLE INSTRUCTIONS

CROSS-REFERENCE TO RELATED APPLICATION

This application claims priority from Japanese Patent Application No. 2015-152317 filed on Jul. 31, 2015, the content of which is incorporated herein by reference in its entirety.

FIELD OF DISCLOSURE

Aspects of the disclosure relate to an image forming apparatus configured to form an image on a sheet and including a heat receiving member configured to thermally fix a developer on the sheet, a control method of the image forming apparatus, and a non-transitory computer-readable medium storing computer-readable instructions for the image forming apparatus.

BACKGROUND

A known image forming apparatus includes a heater configured to generate heat and a heat receiving member configured to receive heat from the heater. The heater and the heat receiving member are configured to thermally fix a developer on a sheet. During continuous printing, heat at a central portion of the heat receiving member in a width direction thereof is lost by sheets passing thereover but the temperature at the central portion is controlled to a specified fixing temperature. As the sheets do not pass over an end portion of the heat receiving member, heat accumulates at the end portion and thus the end portion reaches elevated temperature. In this case, the temperature at the end portion of the heat receiving member (an area where sheets do not pass over) excessively rises, which may result in poor fixing. In addition, the heat receiving member may get damaged depending on a material of the heat receiving member.

From the above reason, control for preventing temperature rise at an end portion of the heat receiving member has been made. For an example, an apparatus is configured to prevent a temperature rise at an end portion of the heat receiving member by increasing a sheet supply interval when a temperature of the heat receiving member sensed at an area where no sheet passes exceeds a specified threshold value.

SUMMARY

The above-described temperature rise at the end portion of the heat receiving member becomes conspicuous during use of narrow sheets, because the narrow sheets do not remove heat from the end portion of the heat receiving member. A user may cut A4-size sheets in half lengthwise and use the halves in portrait orientation to be printed. When such narrow, nonstandard-size sheets are used on the apparatus, the user may select A4-size on the apparatus and the apparatus may control the temperature rise during continuous sprinting in the same manner as when A4-size sheets are printed. Thus, at this time, the temperature rise at the end portion of the heat receiving member becomes a conspicuous problem.

Capability of a heater to heat a heat receiving member varies due to manufacturing variability. In addition, the power supply voltage varies depending on the environment or timing at which the image forming apparatus is used. The heating capability of a heater also varies due to the difference in the power supply voltage. Thus, if controlling the temperature rise at an end portion of the heat receiving member is made based on only a temperature sensed by a sensing member disposed in an area where no sheets pass, the image forming apparatus may unnecessarily enter a mode to control the temperature rise at an end portion of the heat receiving member especially at a so-called cold start that the image forming apparatus is started with its engine cold.

The disclosure has been made in view of the above circumstances and illustrative aspects of the disclosure provide an image forming apparatus configured to, in a case where the capability of a heater is affected by various factors, prevent a controller from unnecessarily entering a control mode to reduce a temperature at an end portion of a heat receiving member, and provide a control method of the image forming apparatus, and a non-transitory computer-readable medium storing computer-readable instructions for the image forming apparatus.

According to an aspect of the disclosure, an image forming apparatus include an image forming unit configured to form a toner image on a sheet, a heater configured to generate heat, a heat receiving member for receiving heat from the heater and configured to fix the toner image on the sheet, a first temperature sensor configured to sense a first temperature of the heat receiving member, a second temperature sensor disposed away from a center of the heat receiving member in a width direction further than the first temperature sensor, the width direction being orthogonal to a sheet conveying direction, the second temperature sensor being configured to sense a second temperature of the heat receiving member, and a controller. The controller is configured to, after the image forming unit starts image formation: when a difference between the first temperature and the second temperature exceeds a threshold value a first number of times, perform a temperature reduction control in which the controller reduces a number of sheets to be printed per unit time and the image forming unit performs image formation for the reduced number of sheets to be printed per unit time; and increase the threshold value in accordance with a time elapsed.

With this structure, the controller determines whether the difference between the first temperature and the second temperature exceeds the threshold value the first number of times. As the first temperature and the second temperature are affected by external factors such as the capability of the heater and power supply, taking the difference between the first temperature and the second temperature may result in reduced effects from various factors. The controller determines whether to perform the temperature reduction control based on the temperature difference, thereby reducing effects from various factors at the cold start, and performing the temperature reduction control at an appropriate timing.

The controller increases the threshold value with the time elapsed. Thus, for wide sheets in use, the controller does not unnecessarily perform the temperature reduction control. For narrow sheets in use, the controller can perform the temperature reduction control appropriately.

According to another aspect of the disclosure, a method of controlling an image forming apparatus is provided. The image forming apparatus includes an image forming unit configured to form a toner image on a sheet, a heater configured to generate heat, a heat receiving member for receiving heat from the heater and configured to fix the toner image on the sheet, a first temperature sensor configured to sense a first temperature of the heat receiving member, and a second temperature sensor disposed away from a center of the heat receiving member in a width direction further than the first temperature sensor, the width direction being orthogonal to a sheet conveying direction, the second temperature sensor being configured to sense a second temperature of the heat receiving member. The method includes: starting the image forming unit to perform image formation; determining a difference between the first temperature and the second temperature after starting; determining whether the difference exceeds a threshold value a first number of times; when the difference exceeds the threshold value the first number of times, performing a temperature reduction control in which a number of sheets per unit time is reduced and the image forming unit performs image formation for the reduced number of sheets to be printed per unit time; and increasing the threshold value with a time elapsed.

According to the method of controlling the image forming apparatus, the image forming apparatus can reduce effects from various factors at the cold start and perform the temperature reduction control at an appropriate timing. As the threshold value is increased with the time elapsed, the image forming apparatus can be prevented from unnecessarily entering a control mode to reduce a temperature at an end portion of the heat receiving member.

BRIEF DESCRIPTION OF THE DRAWINGS

Reference is made to the following description taken in connection with the accompanying drawings, like reference numerals being used for like corresponding parts in the various drawings.

FIG. 5 is a table for setting a first threshold value.

DETAILED DESCRIPTION

An embodiment of the disclosure will be described with reference to the following drawings.

In the following description, the expressions "front", "rear", "up, upper, or top", "down, lower, or bottom", "right", and "left" are used to define the various parts when a laser printer 1 is disposed in an orientation in which it is intended to be used.

Figure 1:
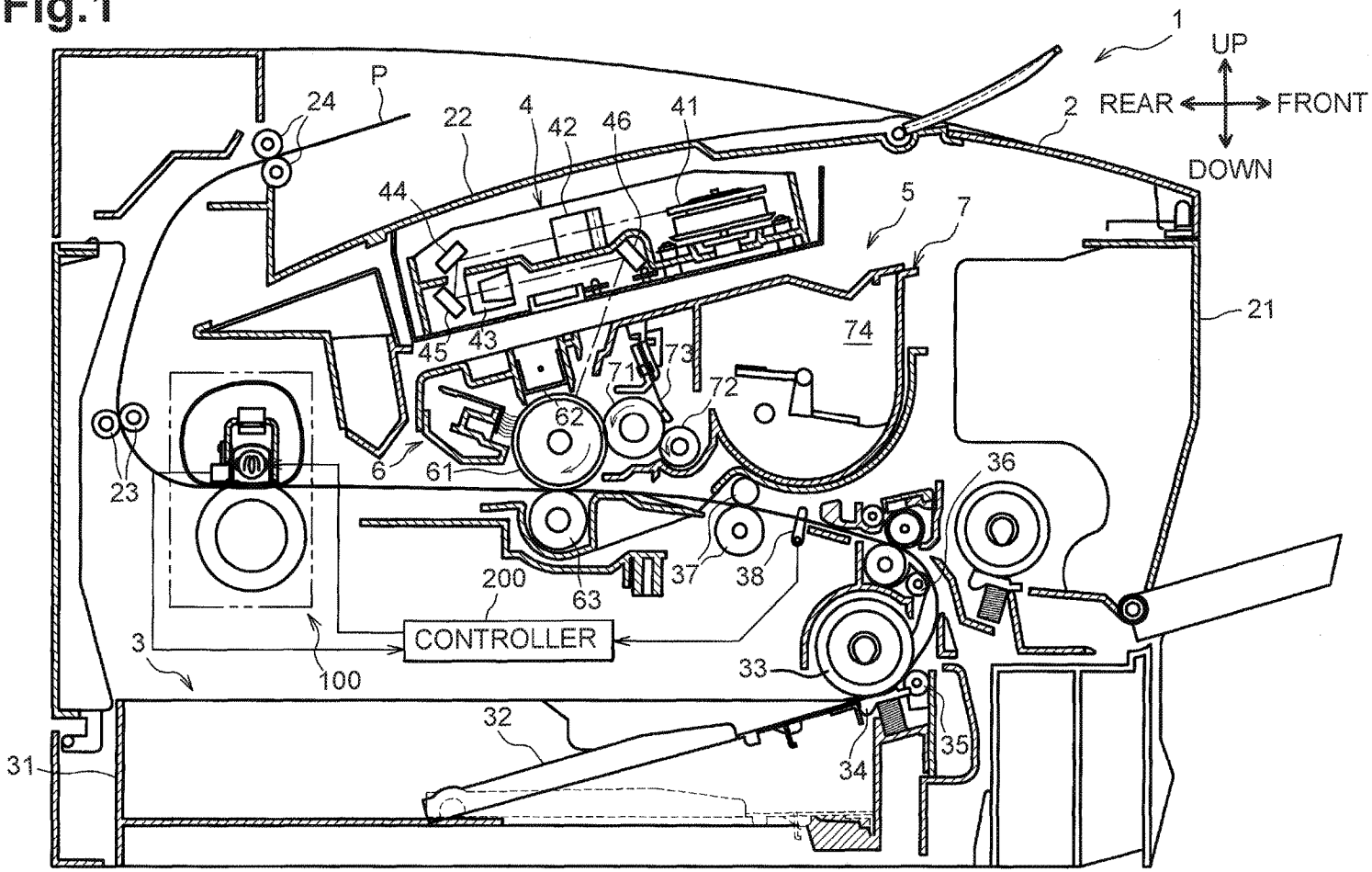
FIG. 1 is a sectional view of a laser printer including a fixing device according to an illustrative embodiment.

As illustrated in FIG. 1, the laser printer 1 includes, in a housing 2, a sheet supply portion 3 configured to supply a recording sheet, e.g., a sheet P, an exposure unit 4, a process cartridge 5 configured to transfer a developer image, e.g., a toner image, onto the sheet P, and a fixing device 100 configured to thermally fix the toner image onto the sheet P.

The sheet supply portion 3 is disposed in a lower portion of the housing 2, and includes a sheet supply tray 31 configured to accommodate a stack of sheets P therein, a sheet pressing plate 32 configured to raise a front portion of a sheet P accommodated in the sheet supply tray 31, a sheet supply roller 33, a sheet supply pad 34, sheet dust removing rollers 35, 36, and registration rollers 37. Sheets P accommodated in the sheet supply tray 31 are raised to the sheet supply roller 33 by the sheet pressing plate 32, and separated one by one by the sheet supply roller 33 and the sheet supply pad 34, and a separated sheet P passes through the sheet dust removing rollers 35, 36 and the registration rollers 37 and is fed toward the process cartridge 5.

The exposure unit 4 is disposed in an upper portion of the housing 2, and includes a laser emitting portion (not illustrated), a polygon mirror 41, lenses 42, 43 and reflective mirrors 44, 45, 46. In the exposure unit 4, laser light (indicated by a dashed line) emitted from the laser light emitting unit is directed to the polygon mirror 41, passes through or is reflected by the lens 42, the reflective mirrors 44, 45, the lens 43, and the reflective mirror 46 in this order, and scans a surface of the photosensitive drum 61 at high speed.

The process cartridge 5 is disposed below the exposure unit 4, and configured to be attached to and removed from the housing 2 through an opening defined by a front cover 21 provided to the housing 2 at an open position. The process cartridge 5 includes a drum unit 6 and a developing unit 7.

The drum unit 6 includes a photosensitive drum 61, a charger 62, and a transfer roller 63. The developing unit 7 is configured to be attached to and removed from the drum unit 6. The developing unit 7 includes a developing roller 71, a supply roller 72, a layer thickness regulating blade 73, and a toner storing portion 74 configured to store developer, e.g., toner, therein.

In the process cartridge 5, the surface of the photosensitive drum 61 is uniformly charged by the charger 62 and exposed to the laser light emitted from the exposure unit 4 and scanning at high speed, and a latent static image based on the image data is formed on the surface of the photosensitive drum 61. Toner stored in the toner storing portion 74 is supplied to the developing roller 71 via the supply roller 72, passes through between the developing roller 71 and the layer thickness regulating blade 73, and is carried on the surface of the developing roller 71 as a thin layer having a constant thickness.

The toner carried on the developing roller 71 is supplied to the electrostatic latent image formed on the photosensitive drum 61. Thus, the electrostatic latent image becomes visible, and a toner image is carried on the surface of the photosensitive drum 61. When a sheet P passes through between the photosensitive drum 61 and the transfer roller 63, the toner image on the photosensitive drum 61 is transferred onto the sheet P.

The fixing device 100 is disposed behind the process cartridge 5. The toner image transferred onto the sheet P passes through the fixing device 100 such that the toner image is thermally fixed onto the sheet P. The sheet P having the toner image thermally fixed thereon is ejected onto an ejection tray 22 by conveying rollers 23, 24.

A sheet sensor 38 is disposed between a sheet supply roller 33 and registration rollers 37 on a sheet conveying path for sensing the passage of a sheet P to sense a length of the sheet P as means for sensing a length of a sheet P. The sheet sensor 38 is connected to a controller 200 such that the sheet sensor 38 outputs, to the controller 200, a signal indicating that a sheet P is passing. The sheet sensor 38 is disposed within a minimum sheet width of sheets P on which the laser printer 1 is configured to form images. In the embodiment, the laser printer 1 is configured to convey sheets P centered relative to the width direction, and thus is disposed at or near the center of sheets P relative to the width direction. In the embodiment, the laser printer 1 may include a plurality of sheet sensors 38. In this case, all sheet sensors 38 should be disposed within the minimum sheet width. With this arrangement, the controller 200 can determine a length of a sheet P being passing but cannot determine a width of the sheet P.

The structure of the fixing device 100 will be described in detail.

Figure 2:
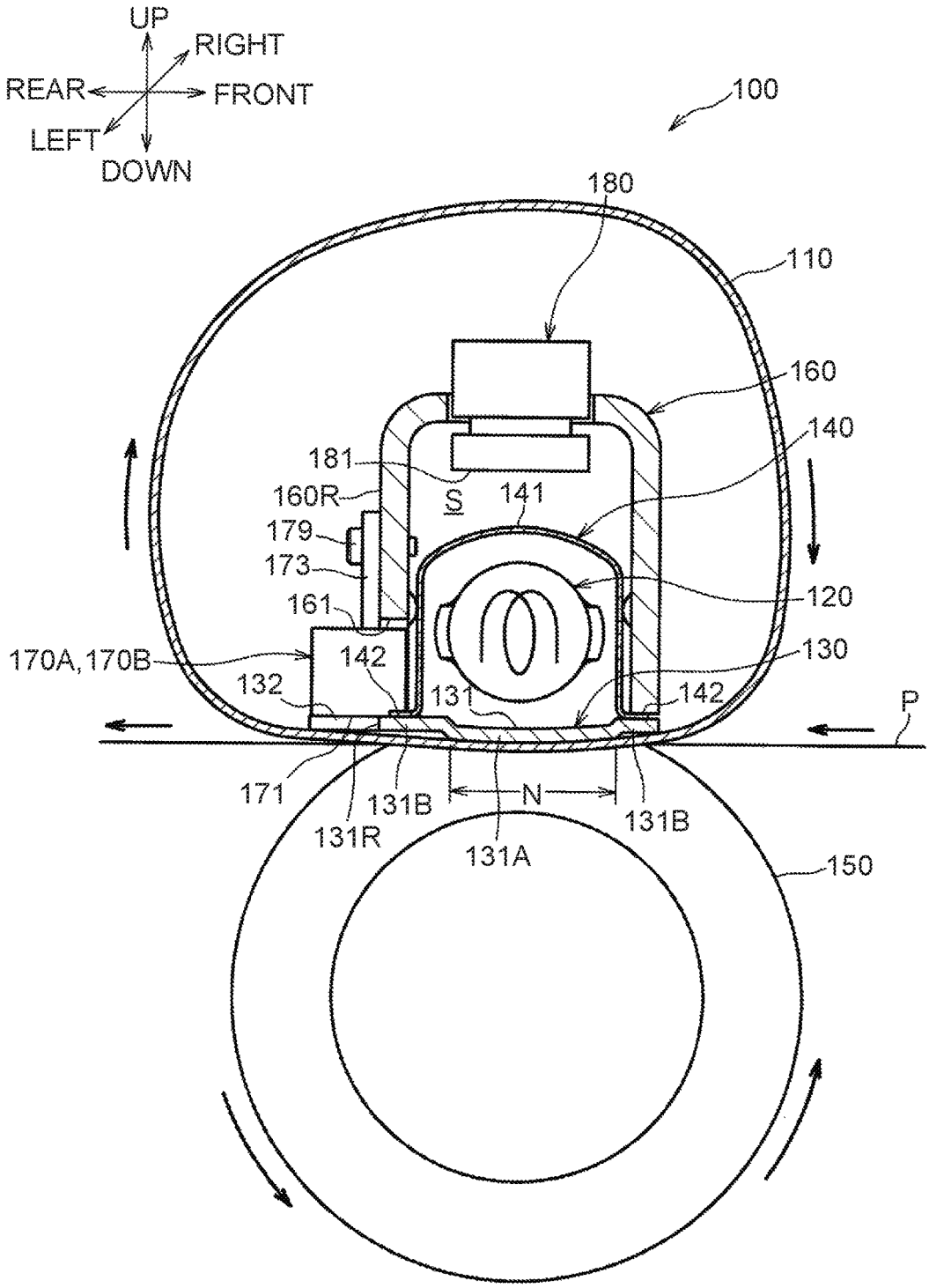
FIG. 2 is a sectional view of the fixing device.
Figure 3:
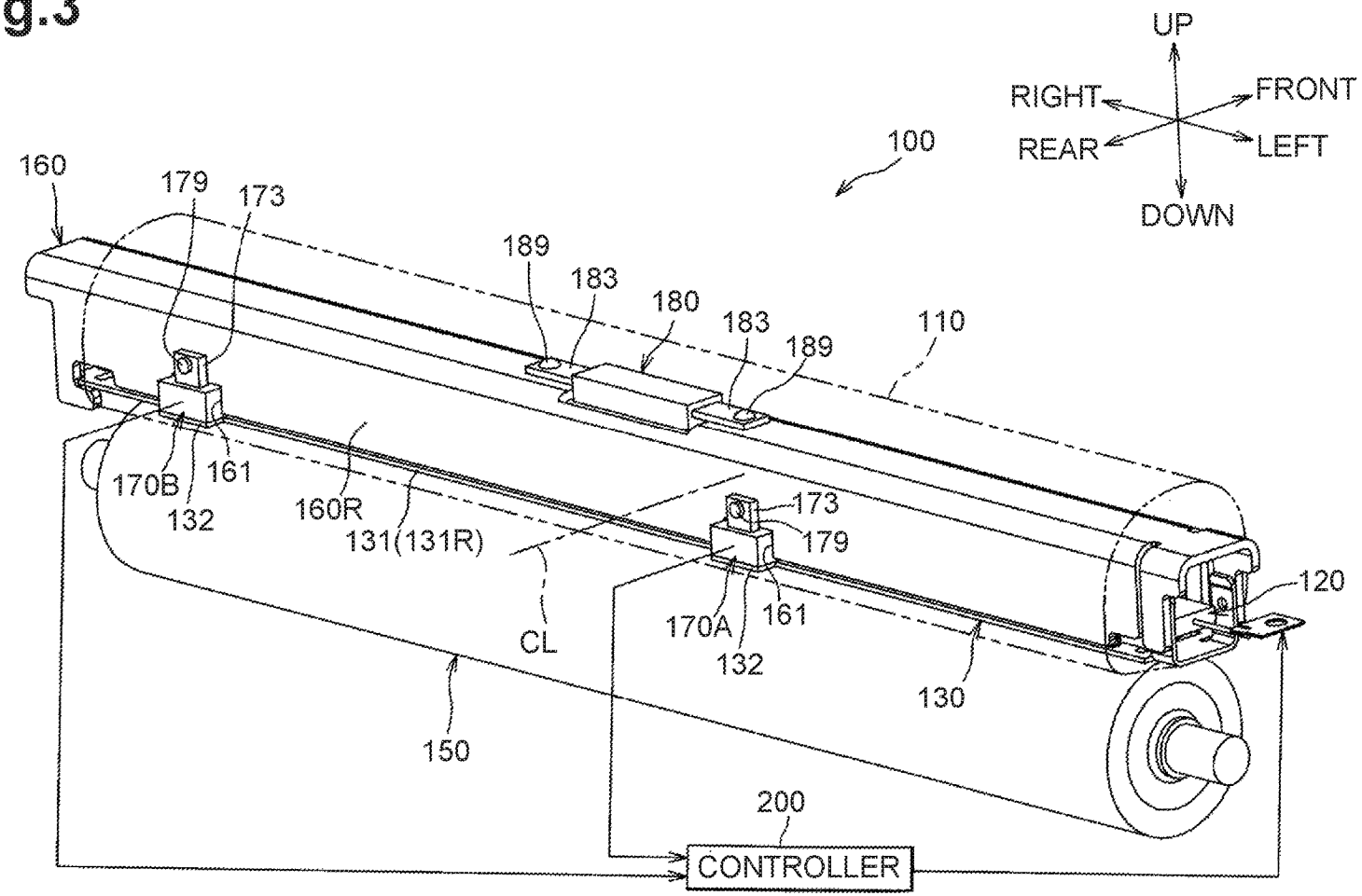
FIG. 3 is a perspective view of the fixing device.

As illustrated in FIGS. 2 and 3, the fixing device 100 includes a fixing belt 110, a halogen lamp 120 as an example of a heater, a nip plate 130, a reflective plate 140, a pressure roller 150 as an example of a backup member, a stay 160, a first thermistor 170A as an example of a first temperature sensor, a second thermistor 170B as an example of a second temperature sensor, and a thermostat 180. The fixing belt 110 and the nip plate 130 are an example of a heat receiving member.

In the following description, a direction in which a sheet P is conveyed (front-rear direction) refers to a conveying direction, and a direction in which a width of a sheet P extends (left-right direction) refers to a width direction, which is orthogonal to the conveying direction. The width direction is a direction along the axial direction of the pressure roller 150 and the longitudinal direction of the halogen lamp 120.

The fixing belt 110 is an endless (or tubular) belt having heat resistance and flexibility, and its rotation is guided by guide members, not illustrated. The fixing belt 110 is configured to thermally fix a toner onto a sheet P while conveying the sheet P. The fixing belt 110 has a base material made of resin or metal such as stainless. As necessary, the base material is covered with a fluorine coating for improving slid ability. A rubber layer may be disposed between the fluorine coating and the base material. When the base material of the fixing belt 110 is resin, polyimide resin as an example may be adopted. Preferably, a resin belt is adopted as the fixing belt 110 because the controller 200 can control a temperature of the fixing device 100 while preventing damage to the resin belt and frequent stoppages of image forming operation. When polyimide resin is used, the glass-transition temperature is about 250 degree Celsius.

The halogen lamp 120 is a heater to configured to heat toner on a sheet 51 by applying radiant heat to heat (a nip portion N between) the nip plate 130 and the fixing belt 110. The halogen lamp 120 is disposed, inside the fixing belt 110, at a specified distance from the fixing belt 110 and an inner surface of the nip plate 130.

The nip plate 130 is shaped like a plate. The nip plate 130 is configured to receive pressing force from the pressure roller 150 and transmit the radiant heat from the halogen lamp 120 to toner on a sheet P via the fixing belt 110. The nip plate 130 is disposed inside the fixing belt 110 such that its lower surface contacts an inner cylindrical surface of the fixing belt 110.

The nip plate 130 is made of metal, e.g., an aluminum plate, having higher thermal conductivity than the steel stay 160. The nip plate 130 includes a base portion 131 and protruding portions 132.

The base portion 131 is bent such that a central portion 131A of the base portion 131 in the conveying direction protrudes toward the pressure roller 150, e.g., downward, further than each end 131B of the base portion 131. An inner surface (or an upper surface) of the base portion 131 may be coated with black paint or provided with a heat absorbing member that absorbs the radiant heat from the halogen lamp 120. With this structure, the radiant heat from the halogen lamp 120 can be efficiently absorbed.

Figure 4:
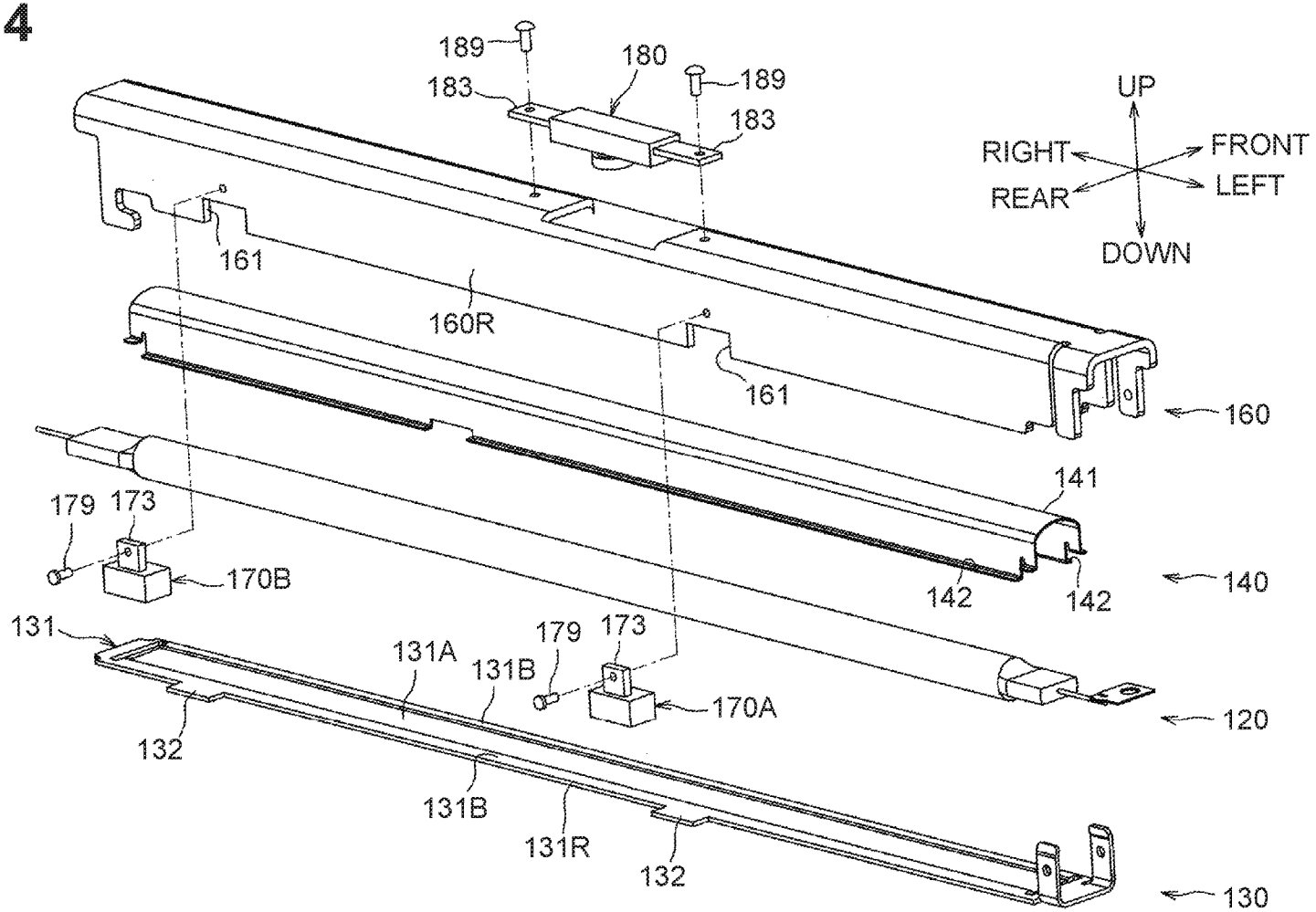
FIG. 4 is an exploded perspective view of a halogen lamp, a nip plate, a reflective plate, a stay, thermistors, and a thermostat.

The protruding portions 132 protrude rearward from a rear end 131R of the base portion 131 in the conveying direction. As illustrated in FIG. 4, there are two protruding portions 132; one is disposed near a right end of the rear end portion 131R of the base portion 131, and the other one is disposed near a central portion of the rear end portion 131R of the base portion 131.

As illustrated in FIG. 2, the reflective plate 140 is configured to reflect the radiant heat from the halogen lamp 120 toward the nip plate 130 (the inner surface of the base portion 131) and is disposed surrounding the halogen lamp 120 at a specified distance from the halogen lamp 120 inside the fixing belt 110.

The radiant heat from the halogen lamp 120 is efficiently collected onto the nip plate 130 by the reflective plate 140, which can promptly heat the nip plate 130 and the fixing belt 110.

The reflective plate 140 is formed by bending, in a substantially U-shape in cross section, a material, e.g., an aluminum plate, having high infrared and far-infrared reflectance and high thermal conductivity. Specifically, the reflective plate 140 includes a reflective portion 141 having a curved shape (a U shape in cross section), and flange portions 142 extending outward in the front-rear direction from respective lower ends of the reflective portion 141. The reflective plate 140 may be formed with an aluminum plate polished to a mirror-smooth state to increase heat reflectance.

The pressure roller 150 is disposed below the nip plate 130 such that the pressure roller 150 and the nip plate 130 sandwich the fixing belt 110 therebetween to form a nip portion N between the fixing belt 110 and the pressure roller 150. Specifically, the nip plate 130 and the fixing belt 110 are pressed toward the pressure roller 150 via the stay 160 using a spring, which is not illustrated. By reaction against the pressing force, the pressure roller 150 presses the nip plate 130, thereby forming the nip portion N between the pressure roller 150 and the nip plate 130. Alternatively, a structure to urge the pressure roller 150 toward the nip plate 130 using a spring may be adopted.

The pressure roller 150 is configured to rotate upon receipt of a driving force transmitted from a motor (not illustrated) disposed in the housing 2. The rotation of the pressure roller 150 allows the fixing belt 110 to be rotated due to friction between the pressure roller 150 and the fixing belt 110 (or a sheet P on the fixing belt 110). The sheet P on which a toner image has been transferred is conveyed to (the nip N) between the pressure roller 150 and the heated fixing belt 110, and thus the toner image is thermally fixed onto the sheet 51.

The stay 160 secures stiffness of the nip plate 130 by supporting both end portions 131B of the base portion 131 of the nip plate 130. The stay 160 has a shape along the outer shape of the reflective portion 141 of the reflective member 140 (substantially U-shape in cross section) and is disposed surrounding the reflective plate 140. The stay 160 is formed by bending, in a U-shape in cross section, a metal plate, e.g., a steel plate, having relatively high stiffness.

The stay 160 and both end portions 131B of the nip plate 130 sandwich the flanged portions 142 of the reflective plate 140 therebetween. With this structure, the reflective plate 140 can be prevented from being shifted vertically, so that the reflective plate 140 can be fixedly positioned relative to the nip plate 130 and adequate stiffness of the reflective plate 140 can be ensured.

A thin space S is defined between an inner surface of the stay 160 and an outer surface of the reflective portion 140 of the reflective plate 140. The thinness of the space S can prevent heat loss due to cooled air streamed in from outside. Air in the space S is likely to remain therein and be subjected to heat. The heated air in the space S serves as a thermal layer minimizing heat flow from the reflective plate 140 to the outside. Thus, the heating efficiency of the nip plate 130 can be improved and the nip plate 130 (the nip portion N) can be promptly heated.

As illustrated in FIGS. 3 and 4, the stay 160 has a rear wall 160R with two cutouts 161 for positioning the first thermistor 170A and the second thermistor 170B. Specifically, the cutouts 161 are shaped at positions corresponding to the protruding portions 132 of the nip plate 130 such that the first thermistor 170A and the second thermistor 170B are positioned in the respective cutouts 161 with a slight clearance from the cutouts 161.

The first thermistor 170A and the second thermistor 170B are known temperature sensors, and are disposed to sense temperatures of the nip plate 130. As illustrated in FIGS. 2 and 3, each of the first thermistor 170A and the second thermistor 170B is disposed within the fixing belt 110. Each thermistor 170A, 170B includes a fixing rib 173 provided on top of a corresponding thermistor. The fixing rib 173 of each thermistor 170A, 170B is fixed with a screw 179 to the rear wall 160R of the stay 160. Each thermistor 170A, 170B has a temperature sensing surface 171 contacting an upper surface of a corresponding protruding portion 132.

The first thermistor 170A is disposed at a position closer to a center (refer to a centerline CL in FIG. 3) of the fixing belt 110 (heat receiving member) in the width direction than the second thermistor 170B. The second thermistor 170B is disposed at a position further away from the center of the fixing belt 110 in the width direction than the first thermistor 170A. The first thermistor 170A may be disposed at the center of the fixing belt 110 in the width direction. When viewed in a vertical direction (which is orthogonal to the longitudinal direction of the halogen lamp 120), the first thermistor 170A is disposed within the minimum sheet width. The minimum sheet width means a minimum width of standard-size sheets, e.g., A5 or A6 size sheets, available on the image forming apparatus, the minimum width being orthogonal to the sheet conveying direction. When viewed in the vertical direction (which is orthogonal to the longitudinal direction of the halogen lamp 120), the second thermistor 170B is disposed outside of the minimum sheet width. The center of the fixing belt 110 in the width direction is disposed at a center of the minimum sheet width in the left-right direction when viewed in the vertical direction (which is orthogonal to the longitudinal direction of the halogen lamp 120).

As illustrated in FIG. 2, each of the thermistors 170A, 170B (only one illustrated in FIG. 2) is disposed outside of the reflective portion 141 of the reflective plate 140 in the conveying direction. Specifically, each thermistor 170A, 170B is disposed outside of the nip portion N and downstream of the reflective plate 140 in the conveying direction. Each thermistor 170A, 170B is spaced from the reflective plate 140 by a slight clearance so as not to contact the outer surface of the reflective portion 141 of the reflective plate 140.

Each thermistor 170A, 170B is connected to the controller 200 (FIGS. 1 and 3) disposed in the housing 2. Detection results of each thermistor 170A, 170B are input to the controller 200. The controller 200 controls a fixing temperature (a temperature at the nip portion N) by controlling output of the halogen lamp 120 and on and off statuses of the halogen lamp 120 based on outputs of the first thermistor 170A and the second thermistor 170B.

The thermostat 180 is a known temperature sensor using a bimetallic strip, and is disposed to sense the temperature of the reflective plate 140. Specifically, the thermostat 180 is disposed within the fixing belt 110 and fixing pieces 183 provided at both ends of the thermostat 180 in the width direction are fixed to an upper wall of the stay 160 with respective screws 189 (FIG. 3). The thermostat 180 is disposed opposite to the halogen lamp 120 relative to the reflective plate 140.

The thermostat 180 is disposed on a circuit for supplying electric current to the halogen lamp 120, and configured to, when sensing a temperature of the reflective plate 140 greater than or equal to a specified value, interrupt the electric current to the halogen lamp 120. This interruption prevents excessive rise in temperature of the fixing device 100.

The following will describe how the controller 200 controls the laser printer 1.

The controller 200 includes a central processing unit or CPU, a random access memory or RAM, a read only memory or ROM, and an external storage device, which are not illustrated. The controller 200 performs controlling of each part of the laser printer 1 by executing computer programs previously stored in the RAM, the ROM or the external storage device.

To prevent a temperature rise at an end portion of the nip plate 130 of the fixing device 100, the controller 200 controls the operation of the laser printer 1 concentrating on the halogen lamp 120 based on a first temperature T1 and a second temperature T2. The first temperature T1 is a temperature at a central portion of the nip plate 130 determined based on an output of the first thermistor 170A. The second temperature T2 is a temperature at an end portion of the nip plate 130 determined based on an output of the second thermistor 170B. In a broad way, when a temperature at an end portion of a heat receiving member (the fixing belt 110 and the nip plate 130), that is, the second temperature T2, rises, the controller 200 performs temperature reduction control (temperature reduction process) to prevent rise in the second temperature T2. In the embodiment, there are a first control and a second control as the temperature reduction control.

The first control is a control to reduce a number of sheets to be printed per unit time and perform image formation for the reduced number of sheets to be printed per unit time, thereby reducing an amount of heat applied to the heat receiving member. In the first control, as a method for performing image formation for the reduced number of sheets to be printed per unit time, the controller 200 may increase the time between sheet supplies without changing a conveying speed of a sheet P, which may include suspension of image formation, or the controller 200 may retard the conveying speed of a sheet P without changing the time between sheet supplies.

The second control is a control to stop the halogen lamp 120 to suspend image formation, thereby dissipating heat and thus lowering the temperature.

It is noted that stopping the halogen lamp 120 referred to here does not include a temporary stopping of power supply during feedback control for maintaining the heat receiving member at a constant temperature. In other words, stopping the halogen lamp 120 means forcibly stopping the halogen lamp 120 in a case where the image formation is suspended by stopping a motor for supplying sheets.

Specifically, "stopping the halogen lamp 120 to suspend image formation" means stopping sheet supply operation or image forming operation such as exposure or developing for several dozen seconds to several dozen minutes. For example, in the second control, the laser printer 1 may be shifted to suspension of the image forming operation, time may be counted for a specified period, and then the laser printer 1 may be returned to the image forming operation. The specified period here may be 20 seconds to 10 minutes or 30 seconds to 3 minutes. The specified period is sufficiently longer than the time between prints during continuous printing. Instead of time counting, when a temperature determined based on an output of the first thermistor 170A or the second thermistor 170B satisfies a specified condition, the laser printer 1 may be returned to the image forming operation.

Specifically, the controller 200 performs the first control when a difference between the first temperature T1 and the second temperature T2 has exceeded a first threshold value T1th, as an example of a threshold value, a first number of times. The difference between the first temperature T1 and the second temperature T2 may be a value itself equal to the difference, a ratio of the difference, or a value calculated from the difference or the ratio by function operation or the operations of addition, subtraction, multiplication, and division. In other words, the difference between the first temperature T1 and the second temperature T2 can be anything as long as information correlating the difference itself at a certain point can be obtained. For example, the controller 200 compares a difference T2-T1 between the first temperature T1 and the second temperature T2 with the first threshold value T1th.

The first threshold value T1th may be a constant or a value changing according to some conditions. In the embodiment, the heat receiving member is likely to be subjected to a sudden temperature rise especially at an end portion of the heat receiving member in a case where the laser printer 1 uses a narrow, nonstandard-size sheet as narrow as a fifth of the width of an A4-size sheet in portrait orientation. From this reason, the first threshold value T1th is set to a value from which it is easy to discriminate between a nonstandard-size sheet in use and a standard-size sheet in use. To set the first threshold value T1th in that way, it is preferable to determine the first threshold value T1th based on parameters such as, a time elapsed from the start of image formation, e.g., the start of sheet supply, and one of the first temperature T1 and the second temperature T2 of when the controller 200 receives a print instruction.

As an example, in the embodiment, the first threshold value T1th is set based on the first temperature T1. Specifically, the controller 200 increase the first threshold value T1th with rise in the first temperature T1. In the embodiment, the first threshold value T1th changes according to conditions except for the first temperature T1. For example, the controller 200 increases the first threshold value T1th in accordance with the time elapsed from the start of image formation. The controller 200 increases a time interval of changing the first threshold value T1th in accordance with the time elapsed, and reduces an amount of change in the first threshold value T1th in accordance with the time elapsed.

In the embodiment, the controller 200 stores, in a memory, a table illustrated in FIG. 5 indicating values for the first threshold value T1th, which are each set based on a time elapsed from the start of sheet supply and a first temperature T1. The controller 200 determines the first threshold value T1th in reference to the table. In FIG. 5, when the first temperature T1 falls within a certain temperature range, the first threshold value T1th is set to a greater number with a longer time elapsed from the start of sheet supply. The amount of change in the first threshold value T1th is reduced with longer time elapsed from the start of sheet supply. The time interval of changing the first threshold value T1th is increased with longer time elapsed from the start of sheet supply. When the time elapsed from the start of sheet supply falls within a certain time range, the first threshold value T1th is set to a greater number as the first temperature T1 is higher.

The controller 200 resets the first threshold value T1th at the completion of jobs having accumulated since the temperature reduction control started.

A value set to the first number of times, described above, may be 1 or 2 or greater. As to a determination whether the difference T2−T1 between the first temperature T1 and the second temperature T2 has exceeded the first threshold value T1th the first number of times (hereinafter, referred to as a "first determination"), the controller 200 may determine that the condition is met (the difference T2−T1 has exceeded the first threshold value T1th) when the difference T2−T1 between the first temperature T1 and the second temperature T2 has exceeded the first threshold value T1th the first number of times "sequentially." Alternatively, the controller 200 may determine that the condition is met when the difference T2−T1 has exceeded the first threshold value T1th the first number of times, regardless of whether the value has exceeded the first threshold value T1th the first number of times "sequentially." In the embodiment, the controller 200 determines that the condition is met when the difference T2−T1 has exceeded the first threshold value T1th the first number of times. Thus, the controller 200 is configured to, when the difference T2−T1 falls short of the first threshold value T1th, reset the number of times the difference T2−T1 has exceeded the first threshold value T1th.

The controller 200 resets the number of sheets to be printed per unit time at the completion of jobs having accumulated since the first control started.

The controller 200 performs the second control when the second temperature T2 has exceeded a second threshold value T2th a second number of times. A value set to the second number of times may be 1 or 2 or greater. In addition, as to a determination whether the second temperature T2 has exceeded the second threshold value T2th the second threshold value T2th the second number of times (hereinafter, referred to as a "second determination"), the controller 200 may determine that the condition is met when the second temperature T2 has exceeded the second threshold value T2th the second threshold value T2th the second number of times sequentially, or that the condition is met regardless of whether the second temperature T2 has exceeded the second threshold value T2th the second number of times sequentially. In the embodiment, the controller 200 determines that the condition is met when the second temperature T2 has exceeded the second threshold value T2th the second number of times sequentially. Thus, the controller is configured to, when the second temperature T2 falls short of the second threshold value T2th, reset the number of counts for which the second temperature T2 has exceeded the second threshold value T2th.

The second threshold value T2th is a reference temperature for determining whether to prevent damage to the fixing belt 110. When the base material of the fixing belt 110 is resin, the second threshold value T2th is preferably set to a temperature lower than the glass-transition temperature of the resin. The second threshold value T2th can be a constant and may be changed according to some kind of condition. The second threshold value T2th can be set to 230 degree Celsius, as an example.

The controller 200 restarts image formation when the second temperature T2 falls short of a fourth threshold value T4th, which is less than the second threshold value T2th, after the second control starts, that is, when the temperature at the end portion of the nip plate 130 gets sufficiently lower and there is little probability that the fixing belt 110 gets damaged.

When conditions for both the first determination and the second determination are met, that is, when the difference T2−T1 between the first temperature T1 and the second temperature T2 has exceeded the first threshold value T1th the first number of times, and the second temperature T2 has exceeded the second threshold value T2th the second number of times, the controller 200 performs the second control to prevent damage to the fixing belt 110.

When the difference T2−T1 between the first temperature T1 and the second temperature T2 has exceeded, a third number of times, the third threshold value T3th, which is greater than the first threshold value T1th, the controller 200 performs the second control. A value set to the third number of times may be 1 or 2 or greater. In addition, as to a determination whether the difference T2−T1 between the first temperature T1 and the second temperature T2 has exceeded the third number of times, the controller 200 may determine that the condition is met when the difference T2−T1 has exceeded the third threshold value T3th the third number of times sequentially or that the condition is met regardless of whether the difference T2−T1 has exceeded the third threshold value T3th the third number of times sequentially. In the embodiment, the controller 200 determines that the condition is met when the difference T2−T1 has exceeded the third threshold value T3th the third number of times sequentially. Thus, the controller 200 is configured to, when the difference T2−T1 falls short of the third threshold value T3th, reset the number of times the value has exceeded the third threshold value T3th. The third threshold value T3th can be set to 90 degree Celsius, as an example.

The controller 200 performs the first determination at a fist time interval, and performs the second determination at a second time interval, which is longer than the first time interval. For example, the controller 200 performs the first determination at each control cycle, and performs the second determination once in ten times.

The first number of times may be set to a greater value than the second number of times. A shift to the first control requires a difficult determination that draws a line between a nonstandard-size sheet and a standard-size sheet. Thus, the determination for the shift to the first control can be made appropriately by setting the first number of times to a rather greater number. On the other hand, a shift to the second control is performed with a relatively easy determination that a temperature at the end portion is high. Thus, the determination for the shift to the second control can be made promptly by setting the first number of times to a rather smaller number.

An example of a process (control method) of the controller 200 will be described with reference to flowcharts illustrated in FIGS. 6-8. In each flowchart, M represents operation mode M. In the operation mode M, 0 indicates a normal printing mode, 1 indicates a mode for performing the first control, and 2 indicates a mode for performing the second control. An initial value of the operation mode M of when receiving a print job is 0.

Figure 6:
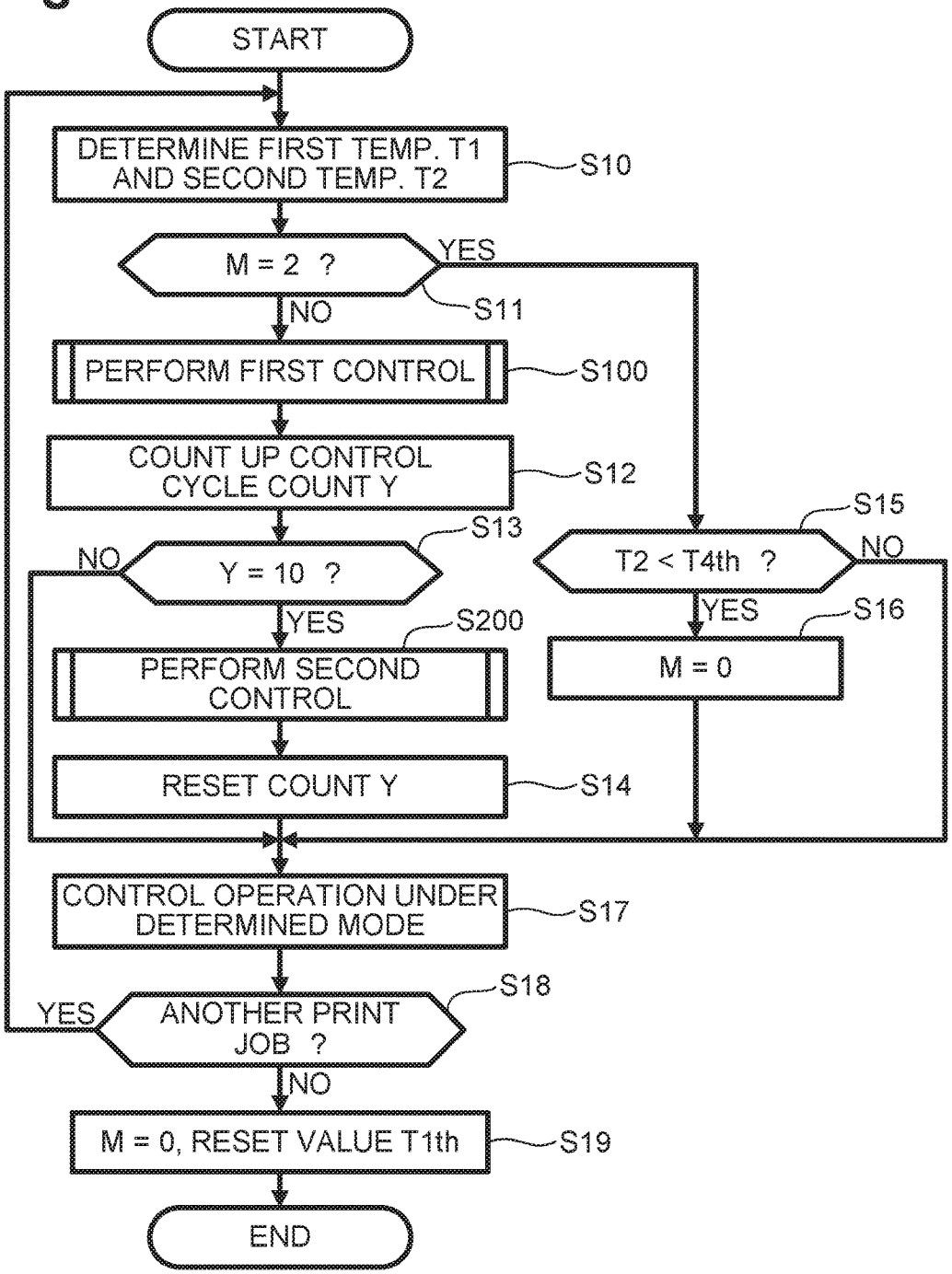
FIG. 6 is a flowchart illustrating an entire process of a controller.

The controller 200 starts a process illustrated in FIG. 6 upon receipt of a print job. The controller 200 determines a first temperature T1 based on an output of the first thermistor 170A and a second temperature T2 based on an output of the second thermistor 170B (S10). The controller 200 determines whether the operation mode M is set to 2 (S11). When the operation mode M is set to 2 (S11, Yes), that is, when the laser printer 1 is suspended because the second control is being performed, the process goes to step S15. In step S15, the controller 200 determines whether it ends the second control. Specifically, the controller 200 determines whether the second temperature T2 is smaller than the fourth threshold value T4th. When the second temperature T2 is smaller than the fourth threshold value T4th (S15, Yes), this means the temperature at the end portion of the fixing belt 110 has been fully lowered, and thus the controller 200 sets the operation mode M to 0 (S16). When the second temperature T2 is not smaller than the fourth threshold value T4th (S15, No), the process goes to step S17 without changing the operation mode M.

When the operation mode M is not set to 2 at step S11 (S11, No), the controller 200 performs the first control at S100.

Figure 7:
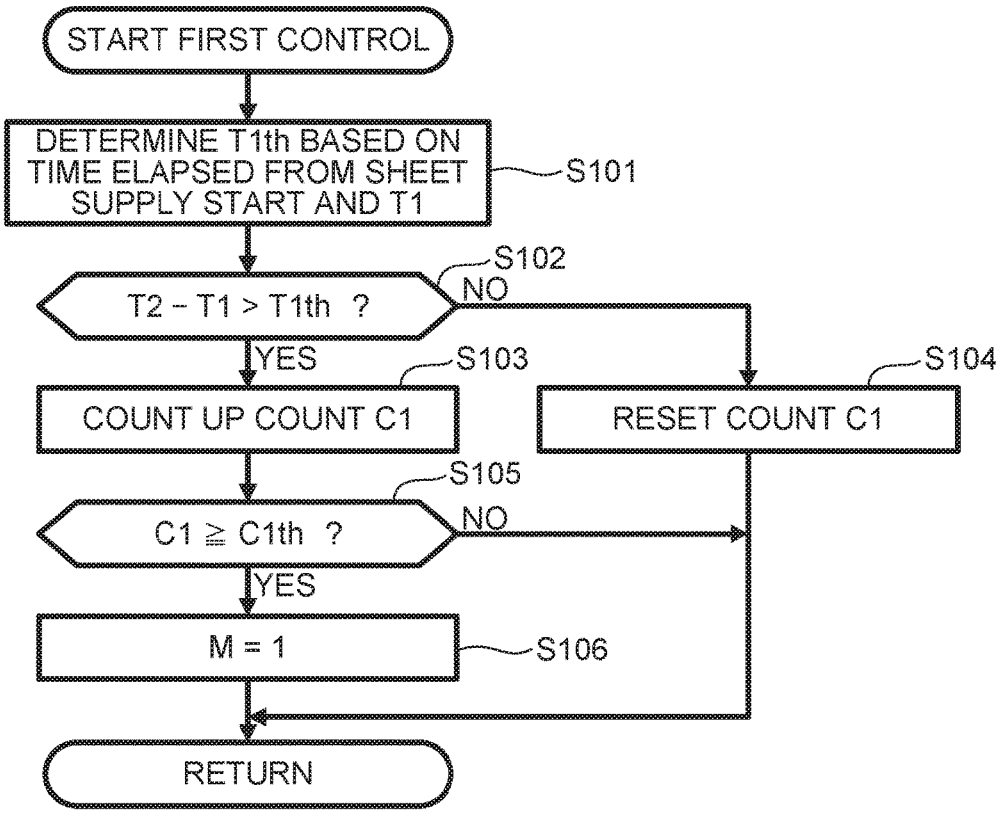
FIG. 7 is a flowchart illustrating a process of a first control.
Figure 8:
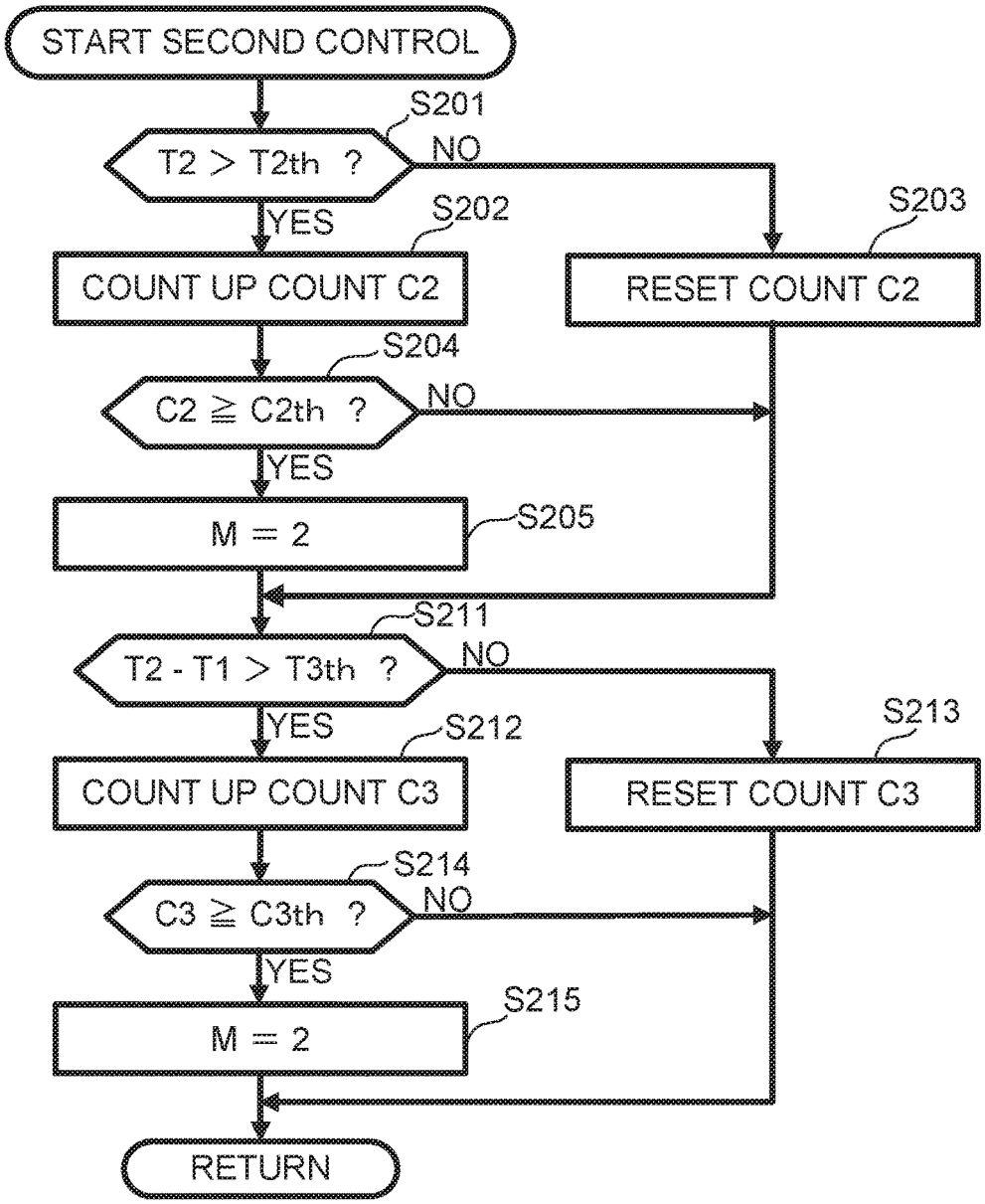
FIG. 8 is a flowchart illustrating a process of a second control.

As illustrated in FIG. 7, in a process of the first control, the controller 200 looks up the table of FIG. 5 and determines the first threshold value T1th based on a time elapsed from a start of sheet supply and the first temperature T1 (S101). The controller 200 determines whether the difference T2−T1 is greater than the first threshold value T1th. When the difference T2−T1 is greater than the first threshold value T1th (S102, Yes), the controller 200 counts up a count C1 (S103). When the difference T2−T1 is not greater than the first threshold value T1th (S102, No), the controller 200 resets the count C1 (S104) and ends the process of the first control.

After counting up the count C1, the controller 200 determines whether the count C1 is greater than or equal to a threshold value (the first number of times) C1th. When the count C1 is greater than or equal to the threshold value C1th (S105, Yes), the controller 200 sets the operation mode M to 1 (S106), and then ends the process of the first control. When the count C1 is not greater than or equal to the threshold value C1th (S105, No), the controller 200 ends the process of first control without changing the operation mode M.

Returning to FIG. 6, the controller 200 counts up a control cycle count Y (S12). The controller 200 determines whether the control cycle count Y is equal to 10 at step S13. When the control cycle count Y is equal to 10 (S13, Yes), the process goes to the second control (S200). When the control cycle count Y is not equal to 10 (S13, No), the process goes to step S17 without performing the second control. In short, by determining whether the control cycle count Y is equal to 10, the controller 200 performs the second control during image formation only once in ten times. On the other hand, the process of the first control is performed during image formation at each control cycle, and the process of the second control is performed at a time interval longer than that in the process of the first control.

The process of the second control will be described with reference to FIG. 8. The controller 200 determines whether the second temperature T2 is greater than the second threshold value T2th. When the second temperature T2 is greater than the second threshold value T2th (S201, Yes), the controller 200 counts up a count C2 (S202). When the second temperature T2 is not greater than the second threshold value T2th (S201, No), the controller 200 resets the count C2 (S203), and the process goes to step S211.

The controller 200 counts up the count C2, and then determines whether the count C2 is greater than or equal to the threshold value (the second number of times) C2th. When the count C2 is greater than or equal to the threshold value C2th (S204, Yes), the controller 200 sets the operation mode M to 2 (S205), and the process goes to step S211. When the count C2 is not greater than the threshold value C2th (S204, No), the process goes to step S211 without changing the operation mode M.

At step S211, the controller 200 determines whether the difference T2−T1 is greater than the third threshold value T3th. When the difference T2−T1 is greater than the third threshold value T3th (S211, Yes), the controller 200 counts up a count C3 (S212). On the other hand, when the difference T2−T1 is not greater than the third threshold value T3th (S211, No), the controller 200 resets the count C3 (S213), and ends the process of the second control.

The controller 200 counts up the count C3, and then determines whether the count C3 is greater than or equal to the threshold value (the third number of times) C3th. When the number of times C3 is greater than or equal to the threshold value C3th (S214, Yes), the controller 200 sets the operation mode M to 2 (S215), and ends the process of the second control. When the count C3 is not greater than the threshold value C3th (S214, No), the controller 200 ends the process of the second control without changing the operation mode M.

Returning to FIG. 6, after the process of the second control (S200), the controller 200 resets the count Y to 0 (S14), and the process goes to step S17.

So far, the controller 200 performs the process of the first control (S100), and then the process of the second control (S200). When the condition to perform the first control is met and the condition to perform the second control is met, the second control overrides the first control and the operation mode M is set to 2.

At step S17, the controller 200 controls the laser printer 1 according to the setting of the operation mode M. When a print job still remains (S18, Yes), the process returns to step S10 to repeat the actions. When no print job remains (S18, No), the controller 200 resets the operation mode M to 0, and resets the first threshold value T1th (S19), and ends the process.

Figure 9A:
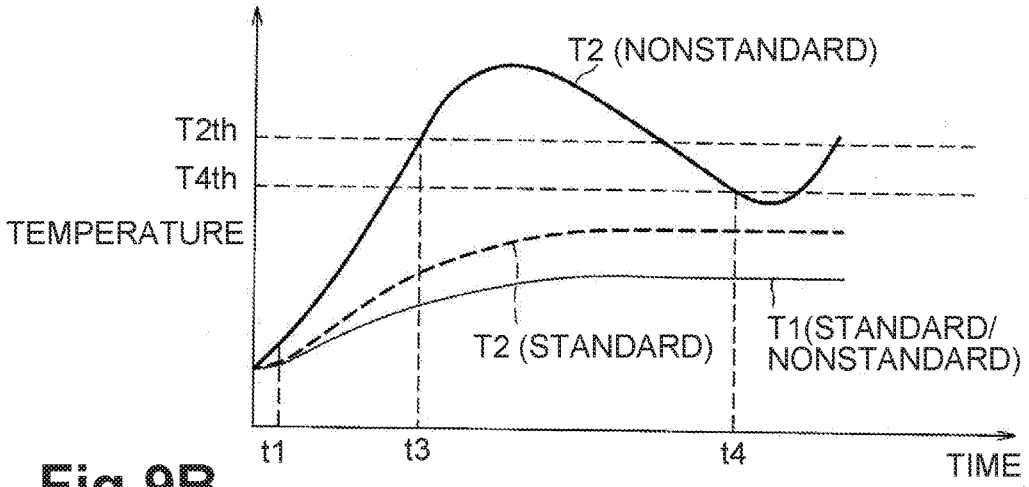
FIG. 9A is a graph illustrating change in a first temperature and a second temperature after a cold start.
Figure 9B:
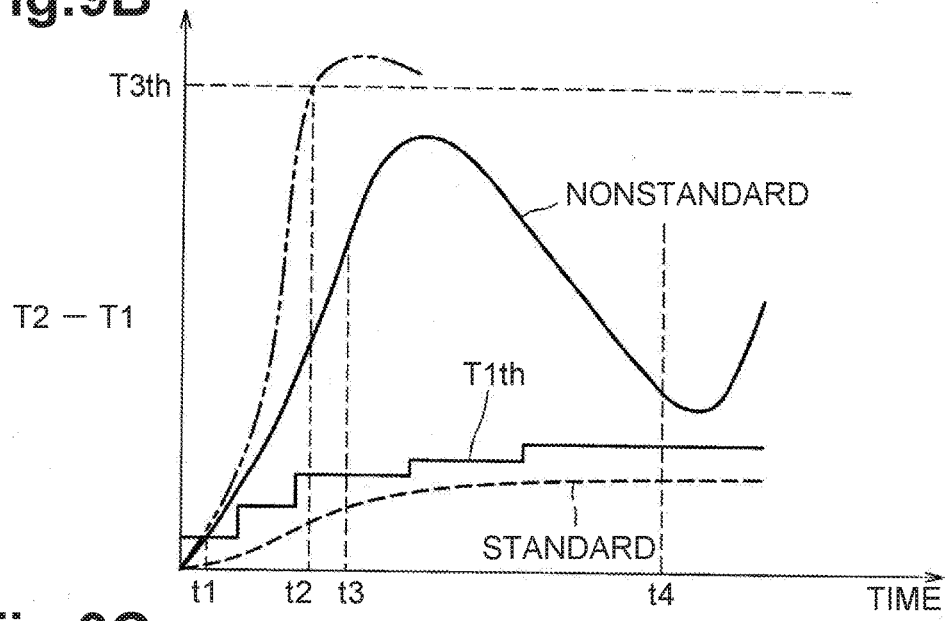
FIG. 9B is a graph illustrating change in a difference between the first temperature and the second temperature after a cold start.
Figure 9C:
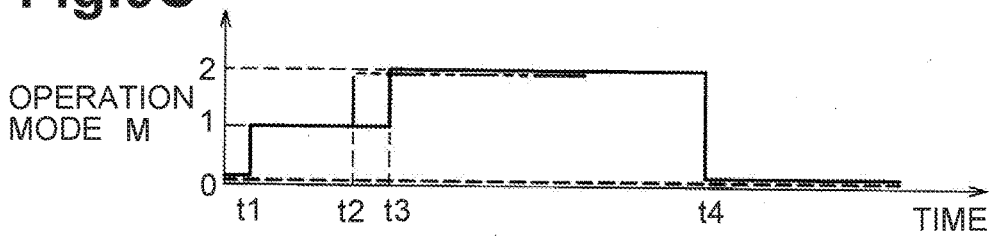
FIG. 9C is a graph illustrating change in an operation mode.

The following will describe an example of operation of the laser printer 1 according to the above process with reference to FIGS. 9A, 9B, and 9C.

FIG. 9A illustrates change in temperature in a case where the laser printer 1 forms images on standard-size or nonstandard-size sheets upon receipt of a print job after a sufficiently long time has elapsed since completion of the previous print job (at the so-called cold start). FIGS. 9B and 9C illustrate change in the difference T2−T1 and change in operation mode M in that case (at the cold start), respectively.

As indicated by a thin solid line of FIG. 9A, regardless of whether a sheet P is a standard-size sheet or a nonstandard-size sheet, the first temperature T1 at or near a central portion of the sheet P in the width direction does not exceed the second threshold value T2th and becomes stable at a specified temperature after a while. On the other hand, as indicated by a thick broken line, the second temperature T2 at or near an end portion of a standard-sized sheet P changes at a higher temperature than the first temperature T1 because heat loss at the end portion is fewer. The second threshold value T2th is set such that the second temperature T2 does not exceed the second threshold value T2th during printing on standard-size sheets. Thus, in a case where standard sheets are used, the second temperature T2 does not exceed the second threshold value T2th and becomes stable at a specified temperature after a while.

As indicated by a thick broken line of FIG. 9B, the difference T2−T1 during use of standard-size sheets does not reach the first threshold value T1th indicated by a thin solid line and becomes stable at a specified temperature after a while. The first threshold value T1th is determined in association with the table of FIG. 5, and becomes greater in stages with the time elapsed from the start of sheet supply. An amount of change in the first threshold value T1th (that is, a step height between each stage in FIG. 9B) becomes smaller with the time elapsed and a changing time interval becomes longer with the time elapsed.

Thus, for printing on the standard-size sheets, the laser printer 1 continues printing with the operation mode M set to 0 as indicated by a broken line of FIG. 9C.

For printing on narrow, nonstandard-size sheets, as indicated by a thick solid line of FIG. 9A, the second temperature T2 at or near the end portion in the width direction greatly rises. Thus, as illustrated in FIG. 9B, the difference T2−T1 also greatly rises after image formation starts, and exceeds the first threshold value T1th at time t1. With the exceeding of the first threshold value T1th at time t1, the operation mode M changes from 0 to 1, and the first control is performed to reduce the number of sheets to be printed per unit time and form images for the reduced number of sheets to be printed per unit time. As indicated by a thick solid line of FIG. 9A, when the second temperature T2 exceeds the second threshold value T2th at time t3, to prevent damage to the fixing belt 110, the operation mode M is set to 2 as illustrated in FIG. 9C, and the second control is performed to stop the halogen lamp 120 and suspend the image formation. As indicated by a thick solid line of FIG. 9A, after time t3, the second temperature T2 gradually falls under the second control. When the second temperature T2 falls short of the fourth threshold value T4th at time t4, the operation mode M is set to 0as illustrated in FIG. 9C and normal printing is resumed.

In the example described above, during printing on the nonstandard sheets, when the second temperature T2 exceeds the second threshold value T2th at time t3, the second control is performed. However, if the first temperature T1 is low, the difference T2−T1 becomes great. When the difference T2−T1 exceeds the third threshold value T3th (time t2), as indicated by a thick two-dot chain line of FIG. 9B, the second control can be performed to prevent damage to the fixing belt 110 (refer to a two-dot chain line of FIG. 9C).

According to the laser printer 1 of the embodiment, the controller 200 performs the first control when the difference T2−T1 between the first temperature T1 and the second temperature T2 exceeds the first threshold value T1th the first number of times. Thus, factors causing variability such as the heating capability of the halogen lamp 120 itself and power supply voltage can be reduced and the controller 200 can perform the first control at an appropriate timing.

When the difference T2–T1 exceeds the first threshold value T1th the first number of times, the controller 200 performs the temperature reduction control to increase the first threshold value T1th with the time elapsed. This prevents damage to the fixing belt 110 by preventing the controller 200 from unnecessarily entering the first control during printing on the standard-size sheets and allowing the controller 200 to promptly enter the first control during printing on the nonstandard-size sheets. In other words, the controller 200 increases the threshold value with the time elapsed, thereby discriminating between the standard-size sheets and the nonstandard-size sheets to control temperature.

As the first threshold value T1th is determined based on at least one of the first temperature T1 and the second temperature T2, temperature control in accordance with the temperature of the heat receiving member can be achieved.

In addition, the controller 200 increases a time interval of changing the first threshold value T1th with the time elapsed, decreases an amount of change in the first threshold value T1th with the time elapsed, and changes an amount in the first threshold value T1th in accordance with the printing mode. Thus, when the standard-size sheets are used, the controller 200 does not unnecessarily enter the temperature reduction control. When the temperature rises at the end portion during printing on the nonstandard-size sheets, the controller 200 can promptly perform the temperature reduction control.

The laser printer 1 uses the fixing belt 110 whose base material is resin. When the fixing belt 110 is subjected to high temperature, it may be damaged. In the embodiment, however, the second threshold value T2th is lower than the glass-transition temperature of the rein constituting the fixing belt 110, and thus damage to the fixing belt 110 can be effectively prevented.

The controller 200 performs the second control when conditions for both the first determination and the second determination are met, that is, when the difference T2–T1 between the first temperature T1 and the second temperature T2 has exceeded the first threshold value T1th the first number of times, and the second temperature T2 has exceeded the second threshold value T2th the second number of times. With this process, damage to the fixing belt 110 can be reliably prevented.

Further, the controller 200 performs the second control when the difference T2–T1 between the first temperature T1 and the second temperature T2 has exceeded the third threshold value T3th the third number of times. Thus, damage to the fixing belt 110 can be prevented more reliably.

The controller 200 performs the first determination at the first time interval, and the second determination at the second time interval, which is longer than the first time interval. In short, the controller 200 frequently performs the first determination, which may be directly linked to damage to the fixing belt 110, to reliably prevent damage to the fixing belt 110, and less frequently performs the second determination, which is not directly linked to damage to the fixing belt 110, to improve efficiency of temperature reduction control.

The controller 200 resets the number of sheets to be printed per unit time at the completion of print jobs, which have accumulated since the start of the first control. Thus, the laser printer 1 can perform image formation at an adequate speed when processing the next print job.

After starting the second control, when the second temperature T2 falls short of the fourth threshold value T4th, the controller 200 resumes image formation. Thus, image formation on all pages of print jobs can be automatically done while damage to the fixing belt 110 can be prevented, so that the laser printer 1 can be used easily.

The laser printer 1 includes at least one sheet sensor 38. As all sheet sensors 38 should be disposed within the minimum sheet width of sheets P on which the laser printer 1 is configured to form images, the sheet sensors 38 can determine the length of a sheet P but cannot determine the width of the sheet P. Thus, the laser printer 1 cannot prevent temperature rise at an end portion by determining the width of the sheet P. Instead, the laser printer 1 can perform the first control at an appropriate timing by determining the temperature at an end portion of the fixing belt 110 as described above. Thus, the laser printer 1 can prevent temperature rise at the end portion without having to stop image formation unnecessarily to keep the user waiting.

In the embodiment, when the difference T2–T1 between the first temperature T1 and the second temperature T2 has exceeded the first threshold value T1th the first number of times, the controller 200 performs the first control. Instead of the first control, the controller 200 may perform the second control. In this case, the controller 200 may set the operation mode M to 2 at S106 in FIG. 7.

In the embodiment, the controller 200 sets the operation mode M to 0 when the second temperature T2 falls short of the fourth threshold value T4th after the start of the second control. Instead, the controller 200 may set the operation mode M to 1.

The above embodiment shows, but is not limited to, the halogen lamp 120 as an example of a heater. The heater may include a ceramic heater or an induction heating (IH) heater. When a ceramic heater is used, the ceramic heater and the nip plate illustrated in the embodiment may be combined. In addition, the heater may be a cylindrical-shaped heating roller.

In the above embodiment, the controller 200 increases the time interval of changing the first threshold value T1th in accordance with the time elapsed. However, the controller 200 does not necessarily to have to increase the time interval in accordance with the time elapsed.

In the above embodiment, a sheet P may be a piece of plain paper, a postcard, a transparency, and other medium.

The above embodiment shows, but is not limited to, the sheet sensor 38 being disposed between the process cartridge 5 and the fixing device 100. The sheet sensor 38 may be disposed at any position on the sheet conveying path.

In the above embodiment, the amount of change in the first threshold value T1th is changed in response to the time elapsed from the start of sheet supply and the first temperature T1. The amount of change in the first threshold value T1th may be changed in further response to a printing mode. For example, the table of FIG. 5 may have values for the first threshold value T1th in response to a printing speed or a type of the sheet P. The amount of change in the first threshold value T1th may be changed in response to the above elements. For example, the thicker the sheet P is, the greater the amount of change in the first threshold value T1th is (that is, the faster the amount of change in the first threshold value T1th is increased). The thinner the sheet P is, the smaller the amount of change in the first threshold value T1th is (that is, the more slowly the amount of change in the first threshold value T1th is increased). In addition, the faster the printing speed is, the greater the amount of change in the first threshold value T1th can be. The slower the printing speed is, the smaller the amount of change in the first threshold value T1th can be.

The above embodiment shows, but is not limited to, that the first threshold value T1th is changed based on the time taken from the start of image formation. The first threshold value T1th may be changed based on the number of sheets printed from the start of image formation.

The above embodiment shows, but is not limited to, the CPU that performs various controls. Part of the controls may be performed by a logic circuit (digital circuit) such as FPGA (Field Programmable Gate Array), ASIC (application specific integrated circuit), or PGA (Programmable Gain Amplifier).

The above embodiment shows, but is not limited to, the laser printer 1 as an example of an image forming apparatus. The image forming apparatus may include a printer using LED for exposure, a copier, and a multifunction apparatus. The above embodiment shows, but is not limited to, the laser printer 1 configured to form a monochrome image on a sheet P as an example of an image forming apparatus including the fixing device to which the disclosure is applied. The image forming apparatus may include a printer configured to form a color image on a sheet P.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A method of controlling an image forming apparatus, the image forming apparatus comprising an image forming unit configured to form a toner image on a sheet, a heater configured to generate heat, a heat receiving member for receiving heat from the heater and configured to fix the toner image on the sheet, a first temperature sensor configured to sense a first temperature of the heat receiving member, and a second temperature sensor disposed away from a center of the heat receiving member in a width direction further than the first temperature sensor, the width direction being orthogonal to a sheet conveying direction, the second temperature sensor being configured to sense a second temperature of the heat receiving member, the method comprising:

starting the image forming unit to perform image formation;

determining a difference between the first temperature and the second temperature after the image forming unit starts to perform image formation;

determining whether the difference exceeds a threshold value a first number of times;

when the difference exceeds the threshold value the first number of times, performing a temperature reduction control in which a number of sheets per unit time is reduced and the image forming unit performs image formation for the reduced number of sheets to be printed per unit time; and increasing the threshold value in accordance with a time elapsed.

2. The method according to claim 1, further comprising stopping the heater and suspending image formation after performing the temperature reduction control.

3. A non-transitory computer-readable medium provided in an image forming apparatus, the image forming apparatus comprising an image forming unit configured to form a toner image on a sheet, a heater configured to generate heat, a heat receiving member for receiving heat from the heater and configured to fix the toner image on the sheet, a first temperature sensor configured to sense a first temperature of the heat receiving member, and a second temperature sensor disposed away from a center of the heat receiving member in a width direction further than the first temperature sensor, the width direction being orthogonal to a sheet conveying direction, the second temperature sensor being configured to sense a second temperature of the heat receiving member, the non-transitory computer-readable medium storing computer-readable instructions, the computer-readable instructions, when executed by a controller of the image forming apparatus, causing the controller to perform:

starting the image forming unit to perform image formation;

determining a difference between the first temperature and the second temperature after the image forming unit starts to perform image formation;

determining whether the difference exceeds a threshold value a first number of times;

when the difference exceeds the threshold value the first number of times, performing a temperature reduction control in which the controller reduces a number of sheets per unit time and the image forming unit performs image formation for the reduced number of sheets to be printed per unit time; and increasing the threshold value in accordance with a time elapsed.

4. An image forming apparatus comprising:

an image forming unit configured to form a toner image on a sheet;

a heater configured to generate heat;

a heat receiving member for receiving heat from the heater and configured to fix the toner image on the sheet;

a first temperature sensor configured to sense a first temperature of the heat receiving member;

a second temperature sensor disposed away from a center of the heat receiving member in a width direction further than the first temperature sensor, the width direction being orthogonal to a sheet conveying direction, the second temperature sensor being configured to sense a second temperature of the heat receiving member; and a controller configured to, after the image forming unit starts image formation:

when a difference between the first temperature and the second temperature exceeds a threshold value a first number of times, perform a temperature reduction control in which the controller reduces a number of sheets to be printed per unit time and the image forming unit performs image formation for the reduced number of sheets to be printed per unit time; and increase the threshold value in accordance with a time elapsed.

5. The image forming apparatus according to claim 4, wherein the controller is configured to, after the image forming unit performs image formation for the reduced number of sheets to be printed per unit time, stop the heater and suspend image formation.

6. The image forming apparatus according to claim 4, wherein the controller is configured to determine the threshold value based on at least one of the first temperature and the second temperature of when the controller receives a print instruction.

7. The image forming apparatus according to claim 4, wherein the controller is configured to increase a time interval of changing the threshold value in accordance with the time elapsed.

8. The image forming apparatus according to claim 4, wherein the controller is configured to reduce an amount of change in the threshold value in accordance with the time elapsed.

9. The image forming apparatus according to claim 4, wherein the controller is configured to reduce an amount of change in the threshold value in response to a printing speed or a printing mode.

10. The image forming apparatus according to claim 4, wherein the controller is configured to reset the threshold value at a completion of jobs accumulated after starting the temperature reduction control.

11. The image forming apparatus according to claim 4, wherein the controller is configured to change the threshold value based on a number of sheets printed after the image forming unit starts image formation.

12. The image forming apparatus according to claim 4, further comprising at least one sheet sensor for sensing a sheet being conveyed, the at least one sheet sensor being disposed within a minimum sheet width of sheets on which the image forming unit is configured to form images.

13. The image forming apparatus according to claim 12, wherein the at least one sheet sensor is for sensing a length of a sheet in the sheet conveying direction.

14. The image forming apparatus according to claim 4, wherein the heat receiving member includes an endless belt configured to contact and convey the sheet.

15. The image forming apparatus according to claim 14, wherein the heat receiving member includes a nip plate being disposed in contact with an inner surface of the endless belt.

16. The image forming apparatus according to claim 4, wherein the heater includes a halogen lamp.

* * * * *